US007371426B2

(12) United States Patent
Rigney et al.

(10) Patent No.: US 7,371,426 B2
(45) Date of Patent: May 13, 2008

(54) METHOD FOR REPAIRING COMPONENTS USING ENVIRONMENTAL BOND COATINGS AND RESULTANT REPAIRED COMPONENTS

(75) Inventors: Joseph D. Rigney, Milford, OH (US); Ramgopal Darolia, West Chester, OH (US)

(73) Assignee: General Electric Company, Schenectady, NY (US)

( * ) Notice: Subject to any disclaimer, the term of this patent is extended or adjusted under 35 U.S.C. 154(b) by 463 days.

(21) Appl. No.: 10/713,938

(22) Filed: Nov. 13, 2003

(65) Prior Publication Data

US 2005/0106315 A1 May 19, 2005

(51) Int. Cl.
*B32B 15/01* (2006.01)
*B32B 15/20* (2006.01)
*B05D 3/12* (2006.01)

(52) U.S. Cl. ..... 427/142; 427/140; 427/328

(58) Field of Classification Search ..... None
See application file for complete search history.

(56) References Cited

U.S. PATENT DOCUMENTS

| | | | | |
|---|---|---|---|---|
| 3,570,449 | A | 3/1971 | Blecherman et al. | 118/712 |
| 5,813,118 | A | 9/1998 | Roedl et al. | 29/889.1 |
| 5,851,409 | A | 12/1998 | Schaeffer et al. | 216/2 |
| 5,972,424 | A | 10/1999 | Draghi et al. | 427/142 |
| 6,042,880 | A * | 3/2000 | Rigney et al. | 427/142 |
| 6,049,978 | A | 4/2000 | Arnold | 29/889.1 |
| 6,074,706 | A | 6/2000 | Beverley et al. | 427/454 |
| 6,153,313 | A | 11/2000 | Rigney et al. | 428/632 |
| 6,174,448 | B1 | 1/2001 | Das et al. | 216/2 |
| 6,210,488 | B1 | 4/2001 | Bruce | 134/1 |
| 6,233,822 | B1 | 5/2001 | Grossklaus, Jr. et al. | 29/889.1 |
| 6,238,743 | B1 | 5/2001 | Brooks | 427/307 |
| 6,255,001 | B1 | 7/2001 | Darolia | 428/610 |
| 6,258,226 | B1 | 7/2001 | Conner | 204/279 |
| 6,274,193 | B1 * | 8/2001 | Rigney et al. | 427/142 |
| 6,283,714 | B1 * | 9/2001 | Rigney et al. | 416/241 R |
| 6,291,084 | B1 | 9/2001 | Darolia et al. | 428/633 |
| 6,305,077 | B1 | 10/2001 | Conner et al. | 29/889.1 |
| 6,326,057 | B1 * | 12/2001 | Das et al. | 427/255.26 |
| 6,334,907 | B1 | 1/2002 | Das et al. | 148/280 |
| 6,355,116 | B1 | 3/2002 | Chen et al. | 148/280 |

(Continued)

FOREIGN PATENT DOCUMENTS

EP 0 985 745 A1 3/2000

(Continued)

*Primary Examiner*—Keith D. Hendricks
*Assistant Examiner*—Jason L. Savage
(74) *Attorney, Agent, or Firm*—Harrington & Smith, PC

(57) ABSTRACT

According to an embodiment of the invention, a repaired component is disclosed. The repaired component comprises an engine run component having a base metal substrate, a portion of the base metal substrate between about 1-3 mils in thickness and an overlying bond coat having been removed to create a remaining base metal substrate of reduced thickness. The repaired component further comprises a lower growth environmental bond coating comprising an alloy having an aluminum content of about 10-60 atomic percent applied to the remaining base metal substrate so that upon subsequent repair of the component, less than about 1-3 mils in thickness of the remaining base metal substrate is removed because of less environmental coating growth into the substrate than the prior bond coat. Advantageously, the repaired component has extended component life and increased repairability.

15 Claims, 2 Drawing Sheets

U.S. PATENT DOCUMENTS

| | | | | |
|---|---|---|---|---|
| 6,379,749 | B2 | 4/2002 | Zimmerman, Jr. et al. | 427/307 |
| 6,434,823 | B1 | 8/2002 | Gupta et al. | 29/889.1 |
| 6,455,167 | B1 * | 9/2002 | Rigney et al. | 428/472.2 |
| 6,468,040 | B1 | 10/2002 | Grylls et al. | 416/224 |
| 6,503,349 | B2 * | 1/2003 | Pietruska et al. | 148/562 |
| 6,544,346 | B1 | 4/2003 | Grossklaus, Jr. et al. | 134/29 |
| 6,560,870 | B2 * | 5/2003 | Das et al. | 29/889.1 |
| 6,575,702 | B2 | 6/2003 | Jackson et al. | 416/96 R |
| 6,586,115 | B2 | 7/2003 | Rigney et al. | 428/633 |
| 6,599,416 | B2 | 7/2003 | Kool et al. | 205/717 |
| 7,078,073 | B2 | 7/2006 | Rigney et al. | 427/142 |
| 7,094,444 | B2 | 8/2006 | Rigney et al. | 427/142 |
| 2002/0009611 | A1 | 1/2002 | Darolia et al. | 428/680 |
| 2003/0021892 | A1 | 1/2003 | Conner et al. | 427/142 |
| 2003/0035892 | A1 | 2/2003 | Darolia et al. | 427/250 |
| 2003/0037437 | A1 * | 2/2003 | Das et al. | 29/889.1 |
| 2003/0082297 | A1 | 5/2003 | Wolkers et al. | 427/140 |

FOREIGN PATENT DOCUMENTS

| | | | |
|---|---|---|---|
| EP | 0 992 612 | A2 | 4/2000 |
| EP | 1 123 987 | A1 | 8/2001 |
| EP | 1 254 967 | A1 | 11/2002 |
| EP | 1 286 020 | A2 | 2/2003 |
| EP | 1 416 063 | A1 | 5/2004 |
| WO | WO 00/17490 | | 3/2000 |

* cited by examiner

METHOD FOR REPAIRING COMPONENTS USING ENVIRONMENTAL BOND COATINGS AND RESULTANT REPAIRED COMPONENTS

CROSS-REFERENCE TO RELATED APPLICATION

The subject application shares certain attributes with U.S. Ser. No. 10/714,213 now U.S. Pat. Nos. 7,078,073 and 10/714,430 now U.S. Pat. No. 7,094,444, entitled, Method for Repairing Coated Components and Method for Repairing Coated Components Using NiA1 Bond Coats, respectively, filed concurrently herewith.

FIELD OF THE INVENTION

The invention relates to a method for repairing components exposed to high temperatures during, for example, gas turbine engine operation. More particularly, the invention relates to a method for repairing components using environmental bond coatings and to the resultant repaired components.

BACKGROUND OF THE INVENTION

Higher operating temperatures for gas turbine engines are continuously sought in order to increase efficiency. However, as operating temperatures increase, the high temperature durability of the components within the engine must correspondingly increase.

Significant advances in high temperature capabilities have been achieved through the formulation of nickel- and cobalt-based superalloys. For example, some gas turbine engine components may be made of high strength directionally solidified or single crystal nickel-based superalloys. These components are cast with specific external features to do useful work with the core engine flow and contain internal cooling details and through-holes to provide external film cooling to reduce airfoil temperatures. Nonetheless, when exposed to the demanding conditions of gas turbine engine operation, particularly in the turbine section, such alloys alone may be susceptible to damage by oxidation and corrosion attack and may not retain adequate mechanical properties. Thus, these components often are protected by an environmental bond coating alone or a bond coat and a top thermal insulating coating often collectively referred to as a thermal barrier coating (TBC) system.

Diffusion coatings, such as aluminides and platinum aluminides applied by chemical vapor deposition processes, and overlay coatings such as MCrAlY alloys, where M is iron, cobalt and/or nickel, have been employed as environmental coatings for gas turbine engine components.

Ceramic materials, such as zirconia ($ZrO_2$) partially or fully stabilized by yttria ($Y_2O_3$), magnesia (MgO) or other oxides, are widely used as the topcoat of TBC systems, when a topcoat is employed. The ceramic layer is typically deposited by air plasma spraying (APS) or a physical vapor deposition (PVD) technique. TBC employed in the highest temperature regions of gas turbine engines is typically deposited by electron beam physical vapor deposition (EB-PVD) techniques.

To be effective, the TBC topcoat must have low thermal conductivity, strongly adhere to the article and remain adherent throughout many heating and cooling cycles. The latter requirement is particularly demanding due to the different coefficients of thermal expansion between thermal barrier coating materials and superalloys typically used to form turbine engine components. TBC topcoat materials capable of satisfying the above requirements have generally required a bond coat, such as one or both of the above-noted diffusion aluminide and MCrAlY coatings. The aluminum content of a bond coat formed from these materials provides for the slow growth of a strong adherent continuous alumina layer (alumina scale) at elevated temperatures. This thermally grown oxide protects the bond coat from oxidation and hot corrosion, and chemically bonds the ceramic layer to the bond coat.

Though significant advances have been made with coating materials and processes for producing both the environmentally-resistant bond coat and the thermal insulating ceramic layer, there is the inevitable requirement to remove and replace the environmental coating and ceramic top layer (if present) under certain circumstances. For instance, removal may be necessitated by erosion or impact damage to the ceramic layer during engine operation, thermal spallation of the TBC or by a requirement to repair certain features such as the tip length of a turbine blade. During engine operation, the components may experience loss of critical dimension due to squealer tip loss, TBC spallation and oxidation/corrosion degradation. The high temperature operation also may lead to growth of the environmental coatings.

Current state-of-the art repair methods often result in removal of the entire TBC system, i.e., both the ceramic layer and bond coat. One such method is to use abrasives in procedures such as grit blasting, vapor honing and glass bead peening, each of which is a slow, labor-intensive process that erodes the ceramic layer and bond coat, as well as the substrate surface beneath the coating. The ceramic layer and metallic bond coat also may be removed by a stripping process in which, for example, the part is soaked in a solution containing KOH to remove the ceramic layer (attack the alumina) and also soaked in acidic solutions, such as phosphoric/nitric solutions, to remove the metallic bond coat. Although stripping is effective, this process also may remove a portion of the base substrate thereby thinning the exterior wall of the part.

When components such as high pressure turbine blades are removed for a full repair, the ceramic and diffusion coatings may be removed from the external locations by stripping processes. The tip may then be restored, if needed, by weld build up followed by other shaping processes. The diffusion coatings and ceramic layer are then reapplied to the blades to the same thickness as if applied to a new component. However, airfoil and environmental coating dimensions/stability are particularly important for efficient engine operation and the ability for multiple repairs of the components. When design is limited to particular minimum airfoil dimensions, multiple repairs of such components may not be possible.

Accordingly, the extent of diffused coated superalloy surfaces needs to be minimized to limit loss in superalloy mechanical properties. Thus, scientists and engineers working under the direction of Applicants' Assignee are continually seeking new and improved bond coats and repair processes to further enhance engine operation efficiency and aid repairability of the components. In particular, coating materials and processes are needed to minimize the subsequent loss of airfoil walls during repair and to extend the overall life cycle of the components.

BRIEF DESCRIPTION OF THE INVENTION

According to an embodiment of the invention, a repaired component is disclosed. The repaired component comprises an engine run component having a base metal substrate, a portion of the base metal substrate between about 1-3 mils in thickness and an overlying bond coat having been removed to create a remaining base metal substrate of reduced thickness. The repaired component further comprises a lower growth environmental bond coating comprising an alloy having an aluminum content of about 10-60 atomic percent applied to the remaining base metal substrate so that upon subsequent repair of the component, less than about 1-3 mils in thickness of the remaining base metal substrate is removed because of less environmental coating growth into the substrate than the prior bond coat. Advantageously, the repaired component has extended component life and increased repairability.

According to another embodiment of the invention, a method for repairing a coated component, which has been exposed to engine operation, is disclosed. The method comprises providing an engine run component including a base metal substrate having thereon a bond coat; and removing the bond coat. A portion of the base metal substrate between about 1-3 mils in thickness also is removed to create a remaining base metal substrate of reduced thickness. The method further comprises applying a lower growth environmental bond coating to the remaining base metal substrate comprising an alloy having an aluminum content of about 10-60 atomic percent so that upon subsequent repair of the component, less than about 1-3 mils in thickness of the remaining base metal substrate is removed because of less environmental coating growth into the substrate than the prior bond coat. Advantageously, the method extends component life and increases repairability of the component.

According to a further embodiment of the invention, a repaired component is disclosed comprising an engine run component having a base metal substrate, a portion of an overlying bond coat on the substrate having been removed. The component further comprises a lower growth environmental bond coating comprising an alloy having an aluminum content of about 10-60 atomic percent applied to the substrate so that upon subsequent repair of the component, less than about 1-3 mils in thickness of the base metal substrate is removed because of less environmental coating growth into the substrate than the prior bond coat. Advantageously, the repaired component has extended component life and increased repairability.

In accordance with a further embodiment of the invention, a repaired gas turbine engine component is disclosed comprising an engine run gas turbine engine component having a base metal substrate, a portion of the base metal substrate between about 1-3 mils in thickness and an overlying bond coat having been removed to create a remaining base metal substrate of reduced thickness. The component further comprises a lower growth environmental bond coating comprising an alloy having an aluminum content of about 10-60 atomic percent applied to the remaining base metal substrate so that upon subsequent repair of the component, less than about 1-3 mils in thickness of the remaining base metal substrate is removed because of less environmental coating growth into the substrate than the prior bond coat. Also, thickness of the environmental bond coating is controlled to produce an integrated aluminum level of less than or equal to about 4000 μm*at. % Al, and wherein the environmental bond coating comprises a β-NiAl overlay coating. Advantageously, the repaired component has extended component life and increasing repairability Other features and advantages will be apparent from the following more detailed description, taken in conjunction with the accompanying drawings, which illustrate by way of example the principles of the invention.

DETAILED DESCRIPTION OF THE INVENTION

The repair method of the present invention is generally applicable to components that operate within environments characterized by relatively high temperatures, and are therefore subjected to severe thermal stresses and thermal cycling. Notable examples of such components include the high and low pressure turbine nozzles and blades, shrouds, combustor liners and augmentor hardware of gas turbine engines. Other examples include airfoils, in general, and static parts such as vanes. One particular example is the high pressure turbine blade 10 shown in FIG. 1. For convenience, the method of the present invention will be described in the context of repairing blade 10. However, one skilled in the art will recognize that the method described below may be readily adapted to repairing any other gas turbine engine part coated with an environmental bond coat, with or without an overlying ceramic layer 22. Accordingly, as used herein, bond coat or environmental bond coat does not require the application of a ceramic top coat.

Figure 1:
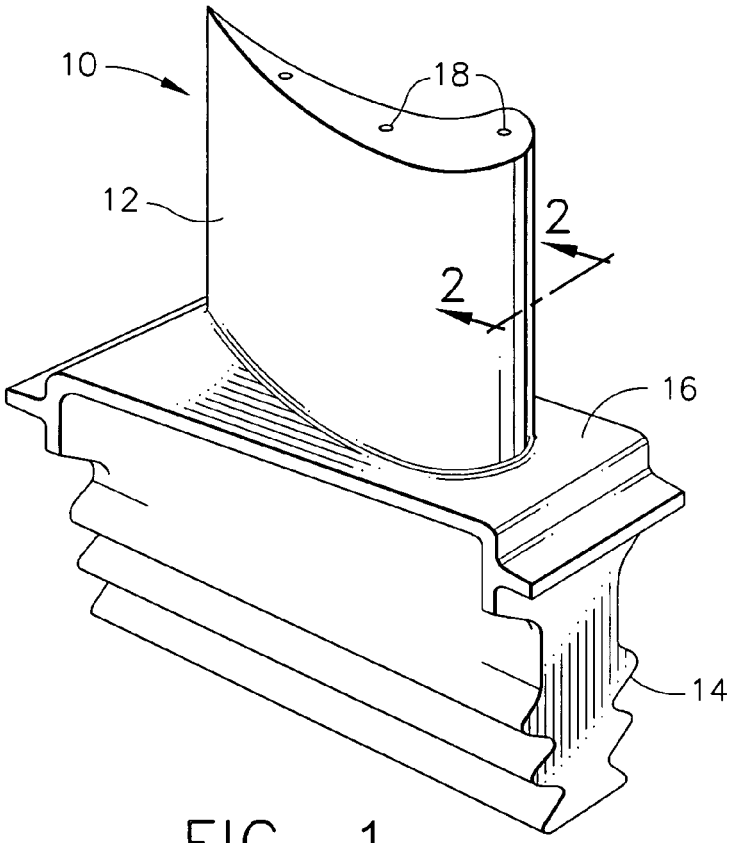
FIG. 1 is a perspective view of a high pressure turbine blade.

The blade 10 of FIG. 1 generally includes an airfoil 12 against which hot combustion gases are directed during operation of the gas turbine engine, and whose surface is therefore subject to severe attack by oxidation, corrosion and erosion. The airfoil 12 is anchored to a turbine disk (not shown) with a dovetail 14 formed on a platform 16 of the blade 10. Cooling holes 18 are present in the airfoil 12 through which bleed air is forced to transfer heat from the blade 10.

The base metal of the blade 10 may be any suitable material, including a superalloy of Ni or Co, or combinations of Ni and Co. Preferably, the base metal is a directionally solidified or single crystal Ni-base superalloy. For example, the base metal may be made of René N5 material. The as cast thickness of the airfoil section 12 of blade 10 may vary based on design specifications and requirements.

Figure 2:
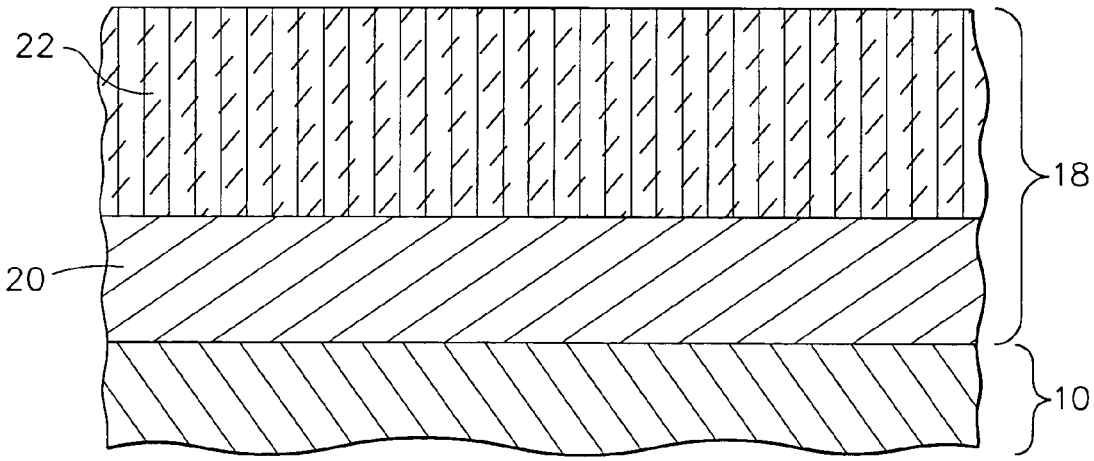
FIG. 2 is a local cross-sectional view of the blade of FIG. 1, along line 2-2 and shows a thermal barrier coating system on the blade.

The airfoil 12 and platform 16 may be coated with a thermal barrier coating system 18, shown in FIG. 2. The thermal barrier coating system may comprise a traditional diffusion bond coat 20 disposed on the substrate of blade 10 and a ceramic thermal barrier coating 22 on top of the bond coat 20. However, the thermal barrier coating 22 is not required to be present for purposes of the present invention.

In an embodiment of the invention, the bond coat 20 is a diffusion coating and the base metal of the blade 10 is a directionally solidified or single crystal Ni-base superalloy. Both the Ni in a nickel-base superalloy and Co in a cobalt-base superalloy diffuse outward from the substrate to form diffusion aluminides, and the superalloys may include both Ni and Co in varying percentages. While the discussion of the superalloy substrate may be in terms of Ni-base superalloys, it will be understood that a Co-base superalloy substrate may be employed. Similarly, the bond coat 20 may comprise a MCrAlY coating or a MCrAlY coating in combination with a diffusion coating.

According to an embodiment of the invention, the diffusion coating may comprise simple or modified aluminides, containing noble metals such as Pt, Rh or Pd and/or reactive elements including, but not limited to, Y, Zr and Hf. The diffusion coating may be formed on the component in a number of different ways. In brief, the substrate may be exposed to aluminum, such as by a pack process or a chemical vapor deposition (CVD) process at elevated temperatures, and the resulting aluminide coating formed as a result of diffusion.

More particularly, a nickel aluminide (NiAl) diffusion coating may be grown as an outer coating on a nickel-base superalloy by exposing the substrate to an aluminum rich environment at elevated temperatures. The aluminum from the outer layer diffuses into the substrate and combines with the nickel diffusing outward from the substrate to form an outer coating of NiAl. Because the formation of the coating is the result of a diffusion process, it will be recognized that there are chemical gradients of Al and Ni, as well as other elements. However, Al will have a high relative concentration at the outer surface of the article which will thermodynamically drive its diffusion into the substrate creating a diffusion zone extending into the original substrate, and this Al concentration will gradually decrease with increasing distance into the substrate. Conversely, Ni will have a higher concentration within the substrate and will diffuse into the thin layer of aluminum to form a nickel aluminide. The concentration of Ni in the diffusion zone will vary as it diffuses outward to form the NiAl. At a level below the original surface, the initial Ni composition of the substrate is maintained, but the Ni concentration in the diffusion zone will be less and will vary as a function of distance into the diffusion zone. The result is that although NiAl forms at the outer surface of the article, a gradient of varying composition of Ni and Al forms between the outer surface and the original substrate composition. The concentration gradients of Ni and other elements that diffuse outwardly from the substrate and the deposited aluminum, Al, create a diffusion zone between the outer surface of the article and that portion of the substrate having its original composition. Of course, exposure of the coated substrate to an oxidizing atmosphere typically results in the formation of an alumina layer over the nickel aluminide coating.

A platinum aluminide (PtAl) diffusion coating also may be formed by electroplating a thin layer of platinum over the nickel-base substrate to a predetermined thickness. Then, exposure of the platinum to an aluminum-rich environment at elevated temperatures causes the growth of an outer layer of PtAl as aluminum diffuses into and reacts with the platinum. At the same time, Ni diffuses outward from the substrate changing the composition of the substrate, while aluminum moves inward into and through the platinum into this diffusion zone of the substrate. Thus, complex structures of (Pt,Ni)Al are formed by exposing a substrate electroplated with a thin layer of Pt to an atmosphere rich in aluminum at elevated temperatures. As the aluminum diffuses inward toward the substrate and Ni diffuses in the opposite direction into the Pt creating the diffusion zone, $PtAl_2$ phases may precipitate out of solution so that the resulting Pt—NiAl intermetallic may also contain the precipitates of $PtAl_2$ intermetallic. As with the nickel aluminide coating, a gradient of aluminum occurs from the aluminum rich outer surface inward toward the substrate surface, and a gradient of Ni and other elements occurs as these elements diffuse outward from the substrate into the aluminum rich additive layer. Here, as in the prior example, an aluminum rich outer layer is formed at the outer surface, which may include both platinum aluminides and nickel aluminides, while a diffusion layer below the outer layer is created. As with the nickel aluminide coating, exposure of the coated substrate to an oxidizing atmosphere typically results in the formation of an outer layer of alumina. Suitable aluminide coatings also include the commercially available Codep aluminide coating, one form of which is described in U.S. Pat. No. 3,667,985, used alone or in combination with a first electroplate of platinum, among other suitable coatings.

The overall thickness of the diffusion coating may vary, but typically may not be greater than about 0.0045 inches (4.5 mils) and more typically may be about 0.002 inches-0.003 inches (2-3 mils) in thickness. The diffusion layer, which is grown into the substrate, typically may be about 0.0005-0.0015 inches (0.5-1.5 mils), more typically, about 0.001 inches (1 mil) thick, while the outer additive layer comprises the balance, usually about 0.001-0.002 inches (1-2 mils). For example, a new make component may have a diffusion bond coat of about 0.0024 inches (about 2.4 mils) in thickness, including an additive layer of about 0.0012 inches (1.2 mils) and a diffusion zone of about 0.0012 inches (about 1.2 mils).

Ceramic thermal barrier coating 22 may then be optionally applied over the bond coat 20. It is noted that a ceramic thermal barrier coating 22 is not required for embodiments of Applicants' repair processes and repaired components. However, if present, ceramic thermal barrier coating 22 may comprise fully or partially stabilized yttria-stabilized zirconia and the like, as well as other low conductivity oxide coating materials known in the art. Examples of suitable ceramics include about 92-93 weight percent zirconia stabilized with about 7-8 weight percent yttria, among other known ceramic thermal barrier coatings. The ceramic thermal barrier coating 22 may be applied by any suitable means. One preferred method for deposition is by electron beam physical vapor deposition (EB-PVD), although plasma spray deposition processes also may be employed for combustor applications. More particular examples of suitable ceramic thermal barrier coatings are described in U.S. Pat. Nos. 4,055,705, 4,095,003, 4,328,285, 5,216,808 and 5,236,745 to name a few. The ceramic thermal barrier coating 22 may have a thickness of between about 0.003 inches (3 mils) and about 0.010 inches (10 mils), more typically on the order of about 0.005 inches (5 mils) prior to engine service. This coating thickness should be considered nominal, as design and manufacturing may intentionally vary coating thickness around the component.

The afore-described coated component, meeting the aerodynamic dimensions intended by design, when entered into service is thus exposed to high temperatures for extended periods of time. During this exposure, the bond coat 20 may grow through interdiffusion with the substrate alloy. The extent of the interdiffusion may depend on the diffusion couple (e.g. coating Al levels, coating thickness, substrate alloy composition (Ni- or Co-based)), and temperature and time of exposure.

In accordance with an aspect of the repair process of the present invention, the above coated blade 10, which has been removed from engine service may be first inspected to determine the amount of wear on the part, particularly with respect to any environmental attack or any spallation of the outer ceramic thermal barrier coating 22. Inspection may be conducted by any means known in the art, including visual and flurosecent penetrant inspection, among others. If necessary, the tip may be conventionally repaired to restore part dimensions.

Next, if needed and if present, the outer ceramic thermal barrier coating 22 may be removed from the blade 10, by means known in the art, including chemical stripping and/or mechanical processes. For example, the ceramic thermal barrier coating 22 may be removed by known methods employing caustic autoclave and/or grit blasting processes. The ceramic thermal barrier coating 22 also may be removed by the processes described in U.S. Pat. No. 6,544,346, among others. All patents and applications referenced herein are incorporated by reference.

After removal of the ceramic thermal barrier coating 22, if present, cleaning processes may be employed as described above to remove residuals. The blade 10 also may be inspected at this stage, for example, by FPI techniques or other nondestructive techniques to further determine the integrity of the blade 10.

At least a portion of the underlying bond coat 20 may then be removed from blade 10. However, prior to removal of the above bond coat 20, if desired, conventional masking techniques may be employed to mask internal features of the blade 10 and protect any internal coating from removal. For example, a high temperature wax capable of withstanding the chemicals and temperatures employed in the bond coat removal step may be injected into the internal portion of the blade 10.

After any desired masking, mechanical processes such as the use of abrasive materials or chemical processes such as aqueous acid solutions, typically a mixture of nitric and phosphoric acids, may be employed to remove or strip off the underlying bond coat 20. In the case of metallic coatings based on aluminum, chemical etching wherein the article is submerged in an aqueous chemical etchant dissolving the coating as a result of reaction with the etchant may be employed. The additive layer of the bond coat 20, typically about 1-2 mils (0.001-0.002 inches), may be removed. Accordingly, during the removal process about 1-3 mils (0.001-0.003 inches) of the interdiffused underlying base metal substrate may be removed thereby resulting in a decrease in airfoil wall thickness.

After the coating removal process, any employed maskant also may be removed. High temperature exposure in vaccum or air furnaces, among other processes may be employed. The part may be conventionally cleaned to remove residuals. For example, water flushing may be employed, among other cleaning techniques.

Welding/EDM and other processes also may be performed, as needed, to repair any defects in the underlying substrate, such as repair and reshaping of tip dimensions.

A new bond coat 21 may then advantageously be applied to the blade 10, replacing prior bond coat 20, in contrast to prior teachings in which the same diffusion bond coat was reapplied to the same prior thickness. Bond coat 21, also referred to as NiAl coating 21 or environmental bond coating 21, for example, does not require the subsequent application of a top ceramic layer.

Applicants have surprisingly determined how the use of alternative lower growth environmental bond coatings 21 can achieve extended component lives by enabling less removal of, for instance, airfoil walls during repair after engine exposure. In particular, conventional diffusion bond coating 20 may be removed during repair, and advantageously replaced with lower growth environmental bond coatings 21 than that used as the prior bond coating or new make coating. Applicants have advantageously determined that if bond coat 20 is replaced with, for example, a NiAl coating 21, further improved performance may be realized.

Bond coat 21 may comprise a NiAlCrZr overlay composition based on β-NiAl and reactive elements, including but not limited to Y, Zr and Hf, with Cr being optional in some instances. For example, bond coat 21 may contain about 30-60 atomic percent aluminum so as to be predominantly of the β-NiAl phase. Other suitable coatings for bond coat 21 include those described in commonly assigned U.S. Pat. Nos. 6,255,001, 6,153,313, 6,291,084, and U.S. application Ser. Nos. 10/029,320, 10/044,618 and 10/249,564.

Bond coat 21 may not be a traditional diffusion aluminide or traditional MCrAlY coating, but instead may advantageously be a NiAl alloy consisting essentially of nickel and aluminum and containing zirconium in a very limited amount has been unexpectedly found to drastically increase the service life of a thermal barrier coating system. For example, zirconium additions of at least 0.2 atomic percent (e.g. 0.2 to about 0.5 atomic percent zirconium) have been shown to significantly improve the life of a thermal barrier coating system. Bond coat 21 thus may be a nickel aluminide bond coat containing zirconium, but otherwise predominantly of the β-NiAl phase, as described in U.S. Pat. No. 6,255,001.

Similarly, bond coat 21 may be predominantly of the β-NiAl phase with limited alloying additions of zirconium and chromium. For instance, bond coat 21 may also contain about 2-15 atomic percent chromium and about 0.1-1.2 atomic percent zirconium, for improved spallation resistance of a TBC deposited on the bond coat 21, as described in U.S. Pat. No. 6,291,084. Bond coat 21 also may contain alloying additions intended to increase creep strength and optionally contain alloying additions to increase fracture resistance and promote oxidation resistance. For instance, bond coat 21 may include additions of chromium, titanium, tantalum, silicon, hafnium and gallium, and optionally may contain additions of calcium, zirconium, yttrium and/or iron, as described in U.S. Pat. No. 6,153,313.

Bond coat 21 may be applied by, for example, using a PVD process such as magnetron sputter physical vapor deposition, or electron beam physical vapor deposition. However, other deposition techniques also may be employed, such as thermal spray or cathodic arc processes. Bond coat 21 also may be applied to any suitable thickness. For instance, an adequate thickness of the bond coat 21 may be between about 0.4 mils (0.0004 inches) to about 5 mils (0.005 mils), and may typically be applied to between about 1 mil (0.001 inches) and about 2 mils (0.002 inches). Bond coat 21 also may typically have a greater additive layer, such as between about 1.5-2 mils (0.0015-0.002 inches) in thickness than a previously removed diffusion bond coat 20, having an additive layer of about 1.2 mils (0.0012 inches).

Bond coat 21 may be deposited in such a manner as to minimize diffusion of the bond coat constituents into the base metal substrate. For instance, a diffusion zone of not more than 12 micrometers, preferably not more than about 5 micrometers, may be achieved during PVD deposition techniques. Although this diffusion zone increases during engine use, depending on temperature and time, this initial reduced level of interaction between the bond coat 21 and substrate promotes the formation of an initial layer of essentially pure aluminum oxide, promotes the slow growth of the protective aluminum oxide layer during service and reduces the formation of voluminous nonadherent oxides of substrate constituents. By limiting diffusion of the bond coat 21 into the substrate during subsequent exposure, minimal substrate material may be removed during refurbishment of the thermal barrier coating system, when both bond and ceramic layers of the coating system are removed to allow deposition of a new bond coat and ceramic layer on the substrate.

Applicants have determined through testing that embodiments of bond coat 21 out-perform some traditional MCrAlY or PtAl based coatings with higher TBC spallation lives and lower coating growth. Moreover, Applicants' bond coat 21 may have a density of about 6.1 g/cm,$^3$ which is lower than some PtAl diffusion coating having a density of about 7.9 g/cm$^3$. Accordingly, with the removal of the higher density bond coat 20 and replacement with a lower density NiAl overlay bond coat 21, further property improvements may be realized without a weight penalty in embodiments of the invention. Bond coat 21 advantageously grows considerably less than typical diffusion coatings in the application process and during engine operation exposure. Accordingly, downstream repairs will result in less base metal loss.

For example, thicknesses of about 1 mil (0.001 inches) of a higher density PtAl diffusion bond coat 20 and about 3 mils (0.003 inches) of an underlying Ni-based alloy (8.64 g/cm$^3$) may be removed during the repair process. A NiAl overlay bond coat 21 having a thickness of about 1-2 mils (0.001-0.002 inches) may be applied plus, if desired, about 2-3 mils (0.002-0.003 inches) of additional ceramic thermal barrier coating 22 or other suitable ceramic material. The coating 22 or other suitable ceramic thermal barrier coating, if present, may be applied to the bond coat 21 using conventional methods.

Figure 3:
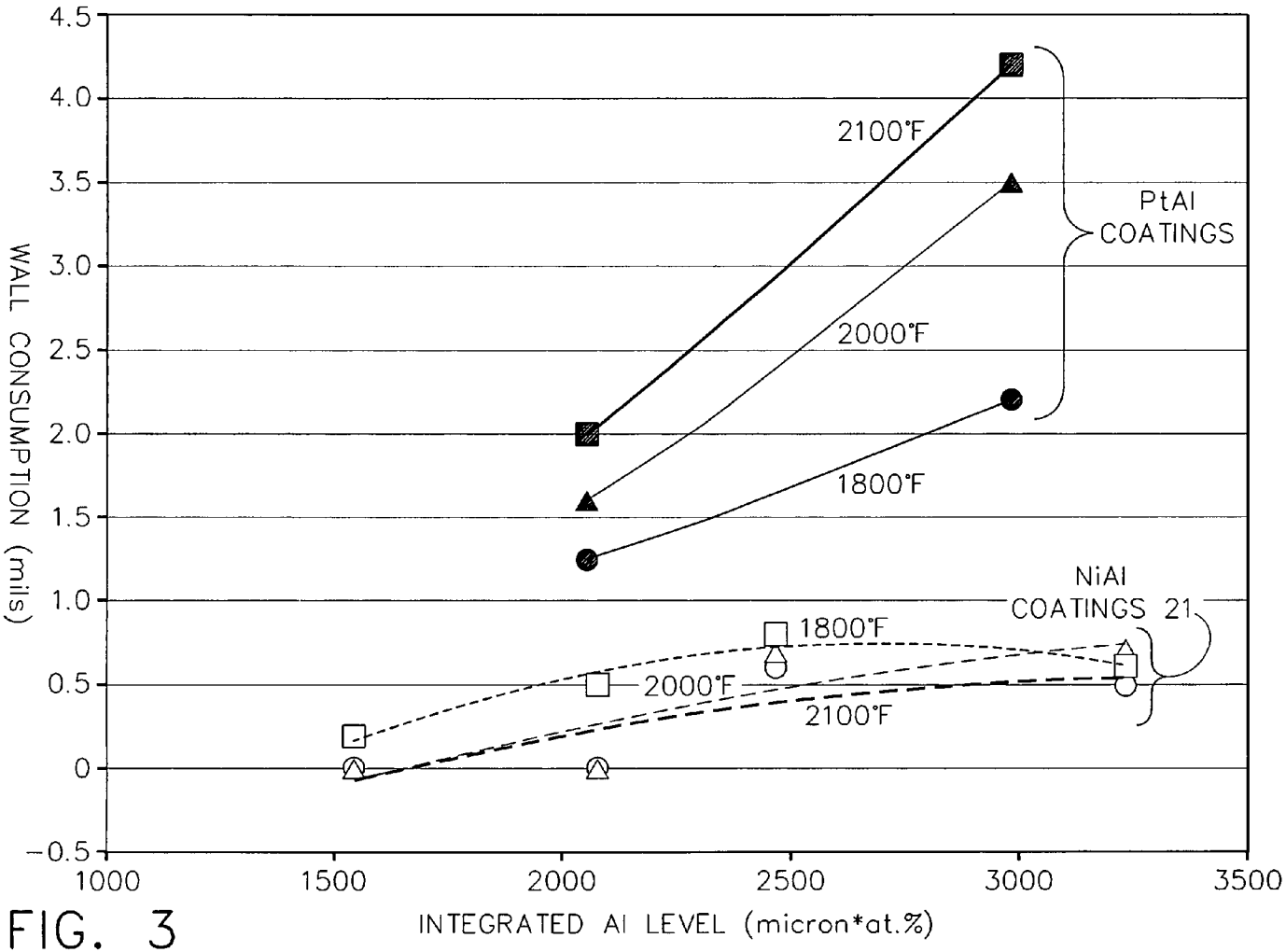
FIG. 3 is a graph illustrating a comparison of diffusion zone thickness/estimated wall consumption at about 100 hours of exposure and various temperatures as a function of integrated Al level in the coating.

According to embodiments of the invention, bond coatings 21, including thin MCrAlY coatings described further below, have been discovered to have advantages over simple aluminide and PtAl diffusion coatings for the level of interdiffusion with the base metal. Thus, Applicants have advantageously determined that alternate lower growth environmental bond coatings 21 have an advantage over simple aluminide and platinum diffusion coatings regarding the level of interdiffusion with the base metal and thus may be employed to replace conventional diffusion coatings during repair to extend the life of the component. For example, FIG. 3 compares the estimated airfoil wall consumption for PtAl diffusion coatings made to either single phase (no $PtAl_2$ precipitates) or two phase (with $PtAl_2$ precipitates) requirements to that of NiAl-coatings 21 at about 100 hours of exposure and at various temperatures as a function of coating Al level.

Coatings were characterized by the amount of Al in the coating with use of electron microprobe analysis (EMPA) techniques. This data can be used in different ways: (a) obtaining an average level of Al in the coating by averaging the EMPA measurements over a certain thickness or down to a fixed Al level (e.g., down to about 30 at. %), or (b) integrating the amount of Al to a certain thickness or down to a fixed Al level. Integration may be accomplished using a trapezoidal integration method to sum up the area underneath an Al content vs. depth into coating curve. The aluminum content was determined using electron microprobe depth scans at about 5 μm intervals from the top of the coating into the base metal and integrating the curve to the point where about 30 atomic % Al was observed in the coating. The integrated Al level is a preferred method to identify coating growth potential, however, average Al level and coating thickness in combination is acceptable.

The PtAl coating, one of which was a single phase and the other two-phase, had different Al measurements:

a) The single phase coating had an average Al level of about 40 at. % and about 51 μm (2 mil) thickness (down to about 30 at. %) or an integrated level of about 2050 μm*at. % Al;

b) The two-phase coating had an average Al level of about 47 at. % and about 63 μm (2.5 mil) thickness (down to about 30 at. %) or an integrated level of about 2980 μm*at. % Al.

The integrated levels may also be estimated by the product of the average aluminum thickness for each coating and the atomic % aluminum for each coating. For example, a 50 μm thick coating with a 35 at. % Al level will have an estimated integrated level of 1750 μm*at. % Al.

At least four NiAl coatings 21 were evaluated, produced by adjusting the level of Al in the source material and the overall thickness of the coating. Most coatings had a nominal thickness of about 1.7-3.3 mils:

(a) one coating had an average Al level of about 36 at. % and about 43 μm (1.7 mil) thickness (down to about 30 at. %) or an integrated level of about 1550 μm*at. % Al;

(b) a second coating had an average Al level of about 38 at. % and about 55 μm (2.2 mil) thickness (down to about 30 at. %) or an integrated level of about 2080 μm*at. % Al;

(c) the third coating had an average Al level of about 41 at. % and about 60 μm (2.4 mil) thickness (down to about 30 at. %) or an integrated level of about 2460 μm*at. % Al; and (d) the fourth coating had an average Al level of about 38 at. % and about 84 μm (3.3 mil) thickness (down to about 30 at. %) or an integrated level of about 3200 μm*at. % Al.

Similarly, the integrated levels may also be calculated by the product of the thickness and the average atomic % aluminum for each coating, as described above.

Advantageously, as shown in FIG. 3, the tested NiAl coatings 21 produced <0.5× coating growth into the base metal as compared to the conventional PtAl diffusion coatings. In particular, the graph shows that the nominal level of base metal interdiffusion (and subsequently that which may be stripped in repair) for all of the PtAl diffusion coatings exceeds that for any of the NiAl coatings 21 studied. For a given Al content of about 38-40 at. % or integrated Al level of about 2000-2100 μm*at. % Al (coating thicknesses about the same), the prior PtAl diffusion coatings produced a greater level of overall wall consumption than the overlay coatings 21. FIG. 3 further advantageously illustrates that the Ni-based overlay coatings 21 in general may produce lower wall consumption, even if they have higher average Al levels and overall higher integrated Al levels.

In addition, application of diffusion coatings during repair that are leaner in Al level (lower average Al and lower integrated levels), below typical production levels of, for example, prior PtAl diffusion coatings, may also be employed as coating 21 and enable improved repairability compared to the conventional PtAl coatings. For example, traditional diffusion coatings modified to comprise an integrated aluminum level less than about 2250 μm*at. % may be employed. This integrated aluminum level would correspond to less than about 45 at. % Al at a thickness of about 50 μm, for example. These coatings may further comprise traditional additional constituents, such as noble metals (e.g., Pt, Rd, Pd, etc.) and/or reactive elements (e.g., Zr, Hf, Y, etc.). As a nonlimiting example, the coatings may comprise between about 0 to about 10 atomic percent noble metals and/or between about 0 and about 2 atomic percent reactive elements.

Accordingly, we have determined that if, for example, a conventional PtAl diffusion coating having an Al content of about 45 at. % and a thickness of about 50 μm, corresponding to about 2250 μm*at. % or greater, is removed from a serviced airfoil for repair and replaced with lower growth bond coat 21, the airfoil may advantageously experience more repair cycles while still meeting airfoil thickness minimum requirements. For instance, if these less wall-consuming overlay coatings or leaner diffusion coatings are employed, at least about 2 to 4 times more repairs may be applied. For example, prior coatings may cause 2 mil or greater of wall loss, whereas embodiments of Applicants' coatings 21 may advantageously lead to only about <0.5 mil to 1 mil wall loss. Moreover, significant cost savings are achieved because fewer parts may need to be unnecessarily scrapped. Other advantages include retainment of mechanical properties of the blade due to less interdiffusion.

Similarly, Applicants have determined that MCrAlY coatings known in the art, but modified as described below may also be employed as bond coat 21 for low wall consumption during repair. In particular, we have determined that MCrAlY coatings, where M is Ni, Co, Fe or combinations thereof and Cr and Y being optional, modified to include about 10-50 at. % Al, or about 15-35 at. % Al, and thicknesses such as less than about 8 mils, so as not to drive the integrated levels to greater than about 4000 μm at. % may be employed. Under these conditions, we may still obtain less than about 1 mil of interdiffusion at, for example, about 2000° F./100 hours. As a nonlimiting example, Cr may be present in amounts between about 4-40 at. %, and more preferably between about 15-25 at. %, and Y may be about 0-2 at. %.

Preferably, the coatings are applied to a thickness not exceeding about 3-8 mils and/or Al integrated level of about 4000 μm at. %, which corresponds to about 20 at. % Al at a thickness of about 8 mils. These coatings may also include reactive elements (e.g., Zr, Hf, Y, etc.), strengthening elements (e.g. W, Re, Ta, etc.) and noble metals, as known in the art. As a further nonlimiting example, between about 0-2 at. % reactive elements, between about 0-5 strengthening elements and/or between about 0-10 at. % noble metals may be included in the coatings. These coatings may also be overaluminized as long as the integrated Al levels are not preferably increased above about 4000 μm*at. %.

The afore-referenced MCrAlY coatings may be applied using conventional application methods including, but not limited to, thermal spray techniques (HVOF, APS, VPS, LPPS, D-gun, shrouded arc, etc.) and physical vapor/droplet deposition (cathodic arc, electron-beam, sputtering, etc.).

When applied to thicknesses of between about 0.5-4 mils, these coatings employed as bond coat 21 may even produce lower levels of wall consumption than some NiAl coatings employed for bond coat 21. Such thin MCrAlY coatings may not be equivalent to the overall performance capability of NiAl coatings 21 or traditionally thicker MCrAlY coatings employed in combination with traditional diffusion coatings. However, these thin MCrAlY coating may be particularly useful in later repair intervals because the time of exposure is typically lower than that of the first interval with the diffusion coating. If improved oxidation life is required, reactive elements may be added to increase oxidation life.

Additionally, although it is desirable to keep coating thicknesses low to drive down the integrated Al level for lower wall consumption, design considerations should also minimize the weight gain due to the applied coating. Weight gain may adversely affect the mechanical stresses developed in all regions of the rotating airfoils, and in the disks to which the airfoils are attached. However, stationary, coated components, such as nozzles (vanes), shrouds, and combustor components, have fewer restrictions from weight gain.

Applicants have advantageously determined how the use of alternate low growth environmental bond coatings 21 in repair processes can achieve extended component life by enabling less removal of airfoil wall after engine exposure. For example, conventional diffusion bond coatings and base superalloy interaction zones may be removed at repair and advantageously replaced with lower growth environmental bond coatings 21 thereby enabling further multiple repair of the components, which may not otherwise have been possible.

While various embodiments are described herein it will be appreciated from the specification that various combinations of elements, variations or improvements therein may be made by those skilled in the art, and are within the scope of the invention.

What is claimed is:

1. A method for repairing a coated component, which has been exposed to engine operation, to produce a repaired component without a weight penalty comprising:

a) providing an engine run component including a base metal substrate having thereon a bond coat;

b) removing the bond coat, wherein a portion of the base metal substrate between about 1-3 mils in thickness also is removed to create a remaining base metal substrate of reduced thickness;

c) applying a lower growth environmental bond coating directly to the remaining base metal substrate comprising an alloy having an aluminum content of about 10 atomic percent, wherein the lower growth environmental bond coating and the remaining base metal substrate of the component interact to form a diffusion zone, and upon subsequent repair of the component, less than about 3 mils in thickness of the remaining base metal substrate is removed because of less environmental coating growth into the substrate than the prior bond coat, thereby extending component life and increasing repairability of the component, wherein the lower growth environmental bond coat has a density less than density of the prior bond coat and the repaired component does not incur a weight penalty in that the repaired component does not weigh more than the component prior to repair.

2. The method of claim 1, wherein not more than about 1 mil in thickness of the remaining base metal substrate of c) is removed.

3. The method of claim 2, wherein thickness of the environmental bond coating of c) is controlled to produce an integrated aluminum level of less than or equal to about 4000 μm*at. % Al.

4. The method of claim 3, wherein the environmental bond coating comprises a material selected from the group consisting of Ni, Al, Cr, reactive elements, noble metals and combinations thereof.

5. The method of claim 1, wherein the bond coat of a) is a diffusion bond coating.

6. The method of claim 5, wherein the environmental bond coating of c) has an integrated aluminum level less than about 2250 μm*at. % Al.

7. The method of claim 6, wherein the environmental bond coating is a diffusion coating.

8. The method of claim 7, wherein the diffusion coating comprises an aluminide diffusion coating.

9. The method of claim 7, wherein the diffusion coating comprises a PtAI diffusion coating.

10. The method of claim 6, wherein the prior bond coat is a PtAl diffusion coating having an integrated aluminum level of about 2250 μm*at. % Al or greater.

11. The method of claim 1, wherein thickness of the environmental bond coating of c) is controlled to produce an integrated aluminum level of less than or equal to about 4000 μm*at. % Al.

12. The method of claim 1, wherein the component is a gas turbine engine component.

13. The method of claim 1, wherein the environmental bond coat has a density of about 6.1 g/cm$^3$ and the prior bond coat has a density of about 7.9 g/cm$^3$.

14. A method for repairing a coated component, which has been exposed to engine operation, to produce a repaired component without a weight penalty comprising:

a) providing an engine run component including a base metal substrate having thereon a bond coat;

b) removing the bond coat, wherein a portion of the base metal substrate between about 1-3 mils in thickness also is removed to create a remaining base metal substrate of reduced thickness;

c) applying a lower growth environmental bond coating directly to the remaining base metal substrate comprising an alloy having an aluminum content selected from the group consisting of about 10 atomic percent, about 15 atomic percent and about 20 atomic percent; and upon subsequent repair of the component, less than about 3 mils in thickness the remaining base metal substrate is removed because of less environmental coating growth into the substrate than the prior bond coat, thereby extending component life and increasing repairability of the component, wherein the environmental bond coating is an MCrAlY coating applied to a thickness range not exceeding between about 3-8 mils, wherein M is selected from the group consisting of Ni, Fe, Co and combinations thereof, with Cr and Y being optional, and the thickness of the environmental bond coating of c) is controlled to produce an integrated aluminum level of less than or equal to about 4000 μm*at. % Al, wherein the environmental bond coating has a density less than density of the prior bond coat and the repaired component does not incur a weight penalty in that the repaired component does not weigh more than the component prior to repair.

15. The method of claim 14, wherein the environmental bond coat has a density of about 6.1 g/cm$^3$ and the prior bond coat has a density of about 7.9 g/cm$^3$.

* * * * *